United States Patent [19]

Billman

[11] Patent Number: 4,614,053

[45] Date of Patent: Sep. 30, 1986

[54] SNAP LINK TYPE CARTRIDGE SPEED LOADING DEVICE

[76] Inventor: Joe L. Billman, 340 N. Lincoln, Pocatello, Id. 83201

[21] Appl. No.: 597,039

[22] Filed: Apr. 5, 1984

[51] Int. Cl.[4] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 913,393 | 2/1909 | Kellogg | 42/89 |
| 1,231,106 | 6/1917 | Wesson | 42/89 |
| 1,891,437 | 12/1932 | Milmore | 42/89 |
| 2,073,436 | 3/1937 | Woodhead | 42/89 |
| 3,213,559 | 10/1965 | Matich | 42/89 |
| 3,722,125 | 3/1973 | Switzer | 42/89 |

*Primary Examiner*—Charles T. Jordan

[57] ABSTRACT

A loading mechanism for securing, storing and releasing rimmed or rimless cartridges into a multiple chamber firearm such as a revolver. This loader consists of a series of links each of which is shaped and proportioned so as to secure a cartridge by clipping around a partial circumference at its base. These links are joined together to provide the proper number of cartridges for a specific firearm. Once secured in the loader, the cartridges may be stored or transported in either a flat or rolled position. When rolled the cartridge links clip together at the open ends such that the axial centerlines of the cartridges correspond in radius to the centerlines of the chambers in the revolver's cylinder. Thus rolled, the cartridges may be simultaneously inserted into their respective chambers in the cylinder and the links may be pulled away to release the cartridges into the chambers, thus rapidly loading the firearm. The link shape is also designed to hold all the cartridges firmly and to insure that the first cartridge which is released from the loader will remain in a raised position to provide a pivot point for the last link's release and insure complete removal of the loader.

8 Claims, 5 Drawing Figures

SNAP LINK TYPE CARTRIDGE SPEED LOADING DEVICE

This invention pertains to Cartridge Handling Mechanisms and specifically to Revolver and Munitions Loading Systems.

The following prior art has come to the attention of the applicant:

U.S. Pat. No. 3,722,125, Fast Loading Cartridge Holder for Revolvers, Robert D. Switzer, Fort Thomas Ky., Mar. 27, 1973 is of a speed loader currently in use. It is designed for the same function as the present invention but depends on an entirely different mechanism, being of one piece unit design using a central camming action to hold and release the cartridges. Whereas; this invention uses links as cartridge holders which hold and release by a flexing-clipping action. Furthermore; the referenced patent's one piece design produces a relatively bulky unit for storage and carring purposes. Whereas; the present invention, due to the nature of the hinged links, may be carried and stored in either a flat or rolled configuration.

U.S. Pat. No. 2,073,436, Revolver Clips, John A. Woodhead, Swarthmore, Pa., Mar. 9, 1937 is a metal link design depending on a metal spring clipping action. However; these link clips are of a single plane material, formed sheet metal, have axis of rotation coincident with the cartridge centers, depends on auxiliary lugs for flexure limitation, holds cartridges with spring clips and thus provides neither a means for easily initiation of cartridge release into the chambers of the revolver nor a positive release of the final round from the clip assembly; and are otherwise dissimilar in form, shape and action from the present invention. Whereas; the Snap Link Device is of a resilient material of three dimensional solid form, has a characteristic and distictively different link shape and articulation, provides not only for easy cartridge release initiation by hyperextention rather than clipping action and positive last round release but also axial single round insertion into the single links as well as transport functions not possible with the Revolver Clip.

U.S. Pat. No. 1,231,106 Cartridge-Pack For Revolvers, Joseph H. Wesson, Springfield, Mass., June 26, 1917 is another metal link design. This pack system is fabricated from flat metal plate linked in a head to head single plane configuration intended to remain as a unit part of the cartridges when loaded in a revolving firearm. It neither provides for any degree of axial stability of cartridges in handling nor subsequent release of the rounds into the chambers and could not be made to do so in any reliable manner. It is also noted that use of such a system would require major modifications to the firearm rendering it unsafe and unusable with unclipped ammunition.

The invention is a unique Snap Link Cartridge Speed Loading Device for use on revolver type firearms. The device, hereafter referred to as the loader, consists of a series of identical hinged links. Each link holds one cartridge by clipping to the shell case at the rim or rear of the cartridge. The number of links will match the number of chambers in the firearm for which it is designed. The loader can be carried or stored in a flat configuration or rolled into a circular configuration with the cartridges parallel. When rolled, the loader is ready for rapid simultaneous insertion of the cartridges into the open chambers of the firearm. Once this assembly is in place, the master, or first, link is pulled outward releasing the first cartridge. As this pulling motion is continued, the loader is stripped away from the remaining cartridges allowing all the cartridges to fall into the chambers of the firearm. The firearm is thus loaded in a quick, reliable and fully visible operation.

The details of construction and function of this invention that follow refer to the accompanying two sheets of drawings, wherein:

FIG. 2 is an isometric drawing showing the loader partially stripped away from the cartridges as they are being loaded into a typical revolver cylinder.

Figure 1:
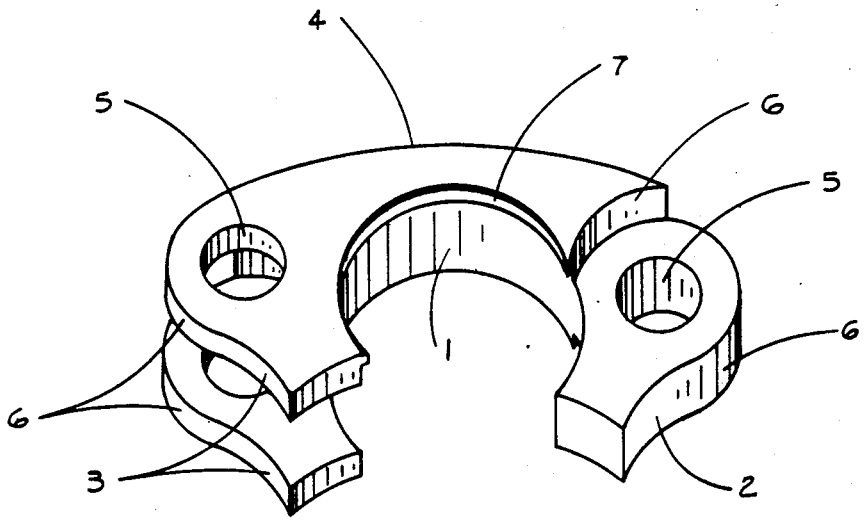
FIG. 1 is an isometric detail drawing of a single link.
Figure 2:
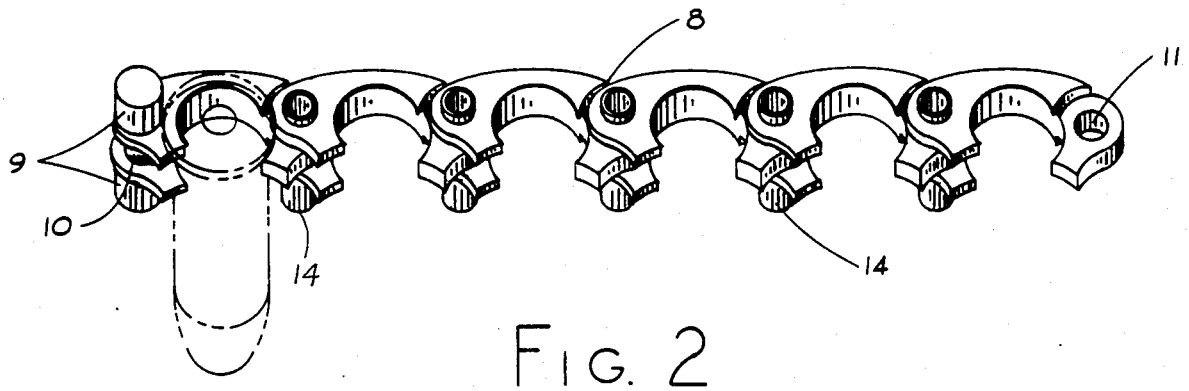
FIG. 2 is an isometric assembly drawing of the loader in the extended position with a single cartridge snapped into place in the first or master link. This drawing also details the grasping lugs of the master link and the connecting hinge pins.
Figure 4:
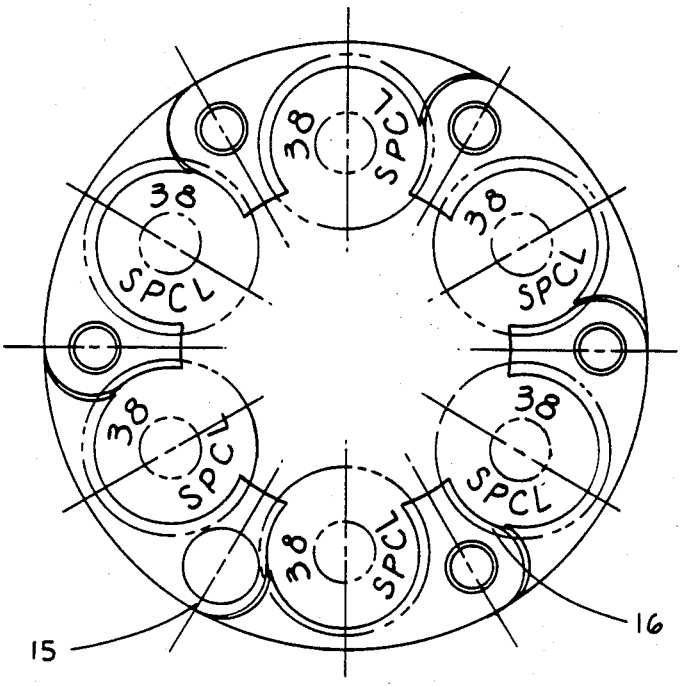
FIG. 4 is a top view of a fully loaded and coiled loader, ready for insertion into the chambers of the firearm.

Individual links for the loader are made of a flexible but firm elastic material such as hard rubber or thermoplastic. They are sized and proportioned such that the cartridges of a specific caliber will snap or clip into or out of the central cylindrical arc 1 of the link body. This arc surface is repeated 2, 3 on the male and female (or tongue and groove) ends respectively, so as to match the cylinder pattern of the intended firearm. The outside arc surface 4 is concentric with and more or less matches the outside diameter of the intended firearm cylinder. Hinge pin holes 5 and matching clearance radii 6 are provided such that the links may be joined end to end in an extended line as shown in FIG. 2 or rolled as shown in FIG. 4. A thin lip 7 is provided near the top face which matches the extractor groove of the cartridge and thus prevents axial movement of the cartridges once they are snapped into place. In cases where a rimmed cartridge without an extractor groove is used, the links may be provided with a groove in place of the retainer lip 7 positioned slightly below the top surface to insure proper capture of the cartridge rim. It should be noted that the aforementioned articulated radii 6 on the male end of the link interferes with the outer link radius 4 as shown at point 8 (typical 5 places) when the loader is bent backwards (hyperextended). This action tends to open the links and thus facilitate insertion and subsequent release of the cartridge bases.

Figure 3:
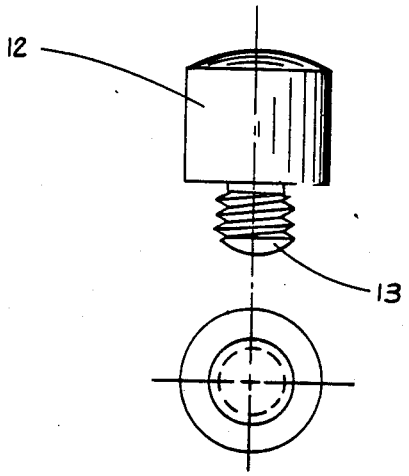
FIG. 3 is an orthographic detail of the modifying lugs used on the master link, more or less on the same scale as FIG. 1.

The first or master link of an assembled loader is modified with lugs 9 for grasping and spherical detents 10 which snap into the open pin hole 11 of the last link when the loader is rolled for insertion into the fire arm. FIG. 3 shows one method which can be used to modify the basic links to function as master links with a large lug surface 12 to provide a thumb hold and a threaded portion to screw into the groove end pin holes 5. Note that the rounded tip of the threaded end 13 should protrude slightly into the groove slot to provide the aforementioned detent action. Hinge pins 14 (FIG. 2 typical 5 places) can extend somewhat below the bottom surface of the loader to maintain frame clearance when loading certain firearms.

In usage the loader is prepared by extending the links and snapping the cartridges into the individual links, rim or primer end up. FIG. 2 shows this process with a phantom cartridge in the master link only. Once all the cartridges are in place, the assembly may be carried or stored in the flat position. The assembly may also be carried or stored in the rolled position ready for rapid loading (see FIG. 4). When rolled the mating ends are held together by the previously detailed detent action. The cartridges are firmly and accurately positioned by the added clamping action of the individual link's end radii 16 (typical 6 places) contacting adjacent cartridges.

Figure 5:
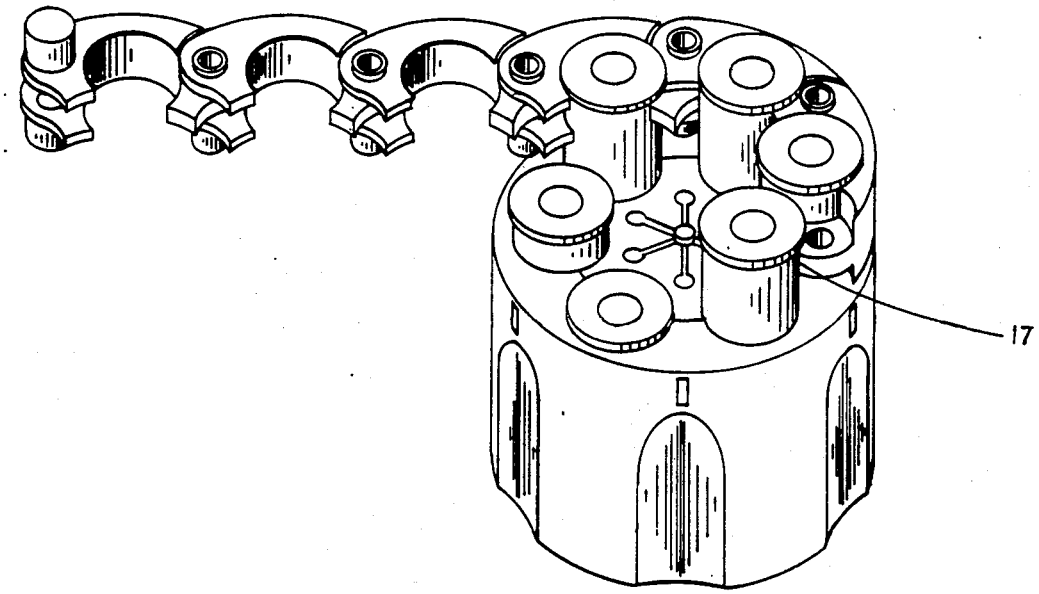

For speed loading, the rolled assembly may be inserted into the chamber end of an open firearm cylinder, projectile end first. The lugs of the master link are manually forced outward in a radial motion breaking the master link free from the detent and simultaneously releasing the first cartridge. This motion is continued by pulling the master link more or less tangentially releasing the cartridges in sequence until the loader is pulled free allowing all the cartridges to fall into their respective chambers thus completing the loading sequence. This process is detailed in FIG. 5 about halfway through the sequence. An important function of the basic link shape 2 is that the first cartridge released is prevented from falling completely into its respective chamber by the head 17 of the last link until the last cartridge is released. Thus the first cartridge provides the pivot point essential for the removal of the last link. Without this pivot, the last cartridge would simply rotate with the last link still in place thus preventing the removal of the loader. In cases where rimless cartridges are used, a slight external spur or integral catch modification is required on the head of the last link to hold up the first cartridge and insure the release of the last cartridge.

In the process of reduction to practice of this speed loading system, it became evident that the same link design used in a segmental or continuous series would lend itself to other transport systems. This flexible link system could be used for reloading or manufacture of cartridges as well as other processes requiring the controlled transport of any items with a roughly circular cross section where ease of insertion or removal is desired. The form of the invention herewith shown and described is taken as a preferred embodiment. Various changes may be made in shape, size and configuration within the constraint of dimensional and functional application to the specific loading and transfer parameters, for example; the tongue and groove hinging aspect can be simplified to overlapping hinge joints with some loss of functional stability in the extended or rolled out configuration.

Having thus described the invention, what is claimed as new and desired to be secured by Letters of Patent is:

1. A device for speed loading revolver type firearms, said device comprising an articulated, head to toe, series of three dimensional, resilient links, equal in number to the number of chambers in a specific revolver cylinder; said links having open sides shaped and sized to grip cartridges by snapping around a partial circumference in the cartridge base region, and having depth sufficient to axially stabilize said cartridges retained therein; said device when loaded with cartridges comprising a linear assembly of parallel cartridges capable of being rolled into a circular configuration matching the revolver chamber pattern for the simultaneous insertion of the cartridges into the cylinder chambers and subsequent release into said chambers through a radil/tangential pull on the first link; said pull causing a serial hyperextension and outward rotation of the individual links to release their corresponding cartridges; and said links being hinged together such that the first cartridge released in the loading sequence is retained above the cylinder's surface by the toe of the last link and acts as a hyperextension point for the last link to effect positive release of the device from the last cartridge.

2. A device as claimed in claim 1, wherein said first link is provided with detent means for releasably aligning and locking the free ends of the first and last link together in the rolled configuration.

3. A device as claimed in claim 2, wherein said detent means comprises slight protrusions from hinge hole positions on the head portion of the first link that fit in a corresponding hinge hole in the toe of the last link to effect a temporary, head to toe, make/break connection.

4. A device as claimed in claim 1, wherein said first link has lug extensions on both sides of the head section to provide finger/thumb gripping surfaces to assist in pulling the device away from the cartridges during loading.

5. A device as claimed in claim 1, wherein said link articulation, with loader extended linearly, is controlled by adjacent hinge relief interference such that hyperextension of individual links is augmented for acceptance and release of cartridges.

6. A device as claimed in claim 1, wherein said link articulation, with the loader in the rolled configuration, is controlled by adjacent cartridge contour relief such that flexation is limited to the arc of the final circular configuration thus insuring accurate alignment/mating of the free ends of the first and last link.

7. A device as claimed in claim 1, wherein said cartridge gripping surfaces include inwardly protruding lips to engage the cartridge rim extractor grooves and thus facilitate axial retention of cartridges.

8. A device as claimed in claim 1, wherein said articulated links utilize hinge pins having expanded heads to overlap the cartridge rim faces thereby axially retaining cartridge types lacking extractor grooves.

* * * * *